US006075210A

United States Patent [19]

Yamanaka

[11] Patent Number: 6,075,210

[45] Date of Patent: Jun. 13, 2000

[54] POLYMER INSULATOR

[75] Inventor: Shinichi Yamanaka, Tokyo, Japan

[73] Assignee: Arai Seisakusho Co., Ltd., Tokyo, Japan

[21] Appl. No.: 08/874,967

[22] Filed: Jun. 13, 1997

[30] Foreign Application Priority Data

Nov. 27, 1996 [JP] Japan ..... 8-316695
Dec. 2, 1996 [JP] Japan ..... 8-321938

[51] Int. Cl.[7] ..... H01B 17/02

[52] U.S. Cl. ..... 174/179; 174/180; 174/195; 174/198

[58] Field of Search ..... 174/176, 178, 174/179, 180, 181, 182, 177, 209, 195, 196, 169, 141 R, 150, 93, 198, 192

[56] References Cited

U.S. PATENT DOCUMENTS

| | | | |
|---|---|---|---|
| 3,672,712 | 6/1972 | Davis | 403/268 |
| 4,281,943 | 8/1981 | Viennot | 403/267 |
| 4,414,429 | 11/1983 | Kaczerginski et al. | 174/179 |
| 5,448,019 | 9/1995 | Berlovan, Jr. | 174/182 |

FOREIGN PATENT DOCUMENTS

| | | | |
|---|---|---|---|
| 656144 | 1/1963 | Canada | 174/176 X |
| 1152434 | 5/1969 | United Kingdom | 174/177 X |

*Primary Examiner*—Dean A. Reichard
*Assistant Examiner*—Dhiru R Patel

[57] ABSTRACT

Polymer Insulator which is characterized by a rode having on its outer surface an umbrella-like housing or insulator layer and having end portions which are formed so as to freely expand with at least one splitting groove; a fixture having a mounting hole in which the end portion of the rod is inserted and which has an inner surface tapering inwards against which the outer surface of said rod abuts in its expanded state; and a wedge fixed in said mounting hole, the wedge being inserted into a splitting groove formed in the end portion of the rod when the end portion of said rod is mounted into said mounting hole of said fixture, the top end of the wedge having an engaging portion which is held in the splitting groove thereby to cause the whole wedge to engage in the splitting grove. This polymer insulator can advantageously increase the fastening force between rod and fixture so that a stable fastening condition between them can be held for a long period, thereby to obtain a polymer insulator of high quality having an excellent global dimension accuracy, and these advantages can be achieved without any adhesives and in a simple assembling operation.

3 Claims, 8 Drawing Sheets

Prior Art

Prior Art

Prior Art

POLYMER INSULATOR

FIELD OF THE INVENTION

This invention relates to a polymer insulator, more particularly to a polymer insulator capable of holding positively for long periods its fastening state wherein rod and fixture means are held stable.

BACKGROUND OF THE INVENTION

Polymer insulators are heretofore known in which housing or envelope of umbrella type as insulating member is attached to a rod formed from resin, onto both ends of said rod are mounted respective metal fixture means. Such polymer insulators are used in various applications such as suspending or retaining use in which only tensile strength is applied as well as in post-insulators or long-stem insulators in which not only tensile strength but also bending moment are applied.

FIG. 1 is a schematic view of fixing portion of a rod onto a fixture means in an example of heretofore known polymer insulators. In said polymer insulator 1, an insulating housing 2 of umbrella type (shown only in its part) is fixed onto an end of a rod 3 formed from resin such as FRP, said end of the rod 3 being mounted into an inwardly tapering hole 5 processed with parting agent and formed on one end of a fixture means 4 made from metal such as black heart malleable castings. Adhesive material 6 such as epoxy resin which can be joined only to said rod 3 is filled between the outer surface of rod 3 and the inner surface of said tapering hole 5, thereby to form a draft-preventing member 7. In practice, soft adhesive material 6 before its setting is injected into said bottom surface 5*a* of tapering hole 5, and rod 3 is then pushed onto said bottom surface 5*a* of said hole 5, thereby to push out said adhesive material 6 so as to form a wedge form between the outer surface of said rod 3 and the inner surface of said tapering hole 5. Subsequently, said adhesive material 6 is left to set so as to cause said adhesive material 6 to join only onto said outer surface of said rod 3 thereby to form said draft-preventing member 7. Further, a counter-tensile charge P which is larger than the greatest charge in use is beforehand applied in the direction shown by the arrow in FIG. 1, so as to generate an urging force in the direction separating said rod 3 and said fixture 4 from each other. As a result, a gap 8 is formed on said bottom surface 5*a* of said tapering hole 5 by causing said rod 3 to shift in said direction of said arrow due to said counter-tensile force P.

In the polymer insulator 1 as described above, when a tensile force is applied on said polymer insulator 1 in a direction such as to separate said rod 3 and said fixture means 4 from each other, said draft-preventing member 7 exhibits its wedge effect in order to prevent said rod 3 from drafting from said fixture means 4.

The polymer insulator 1 having a draft-preventing fixture 7 as shown in FIG. 1 shows no problems when used for suspending or retaining application wherein only the tensile charge is applied thereon. On the contrary, when used as post-insulator or as long-stem insulator wherein bending moment M is repeatedly applied as shown by the dashed line in FIG. 1, said rod 3 shifts in a direction counter to said counter-tensile direction P (as called usually "Rod Shift"), thereby to form a gap (usually called "Play") between the inner surface of said tapering hole 5 and the outer surface of said draft-preventing member 7 formed by said adhesive material 6. Generation of this Play increases oscillation of said rod 3 caused by bending moment M which has edges of opening of said tapering hole 5 and corresponding portions of outer surface of said rod 3 as its supporting points, so that said inside surface of tapering hole 5 and said outer surface of said draft-preventing member 7 not only slide with friction on each other, but also at least outer surface of said draft-preventing member 7 wears from the side of its bottom surface 5*a,* causing thus its relaxation, with the final result that said rod 3 is drawn out from said fixture means 4.

For the purpose of solving the problems described above, a structure as shown in FIG. 2 is conceivable. FIG. 2 is a schematic view of fixing portion of a rod onto a fixture means. This structure has been designed for increasing the fastening force between rod and fixture means with respect to the embodiment shown in FIG. 1. In said polymer insulator 1A, an insulating housing 2A of umbrella type (shown only in its part) is fixed onto an end of a rod 3A formed from resin such as FRP, said end of the rod 3A being mounted into an inwardly tapering hole 5A formed on one end of a fixture means 4A made from metal such as black heart malleable castings. An end portion of said rod 3A has therein a splitting groove 9 having substantially parallel groove edges for dividing said rod 3A in a diametrical direction. A wedge 10 fixed to substantially central portion of said bottom surface 5Aa of said tapering hole 5A is inserted into said splitting groove 9, and an adhesive member 6A such as epoxy resin is filled in the gap between said splitting groove 9 and said wedge 10, with said adhesive member 6A joining only to said rod 3A. When the end portion of said rod 3A is inserted into said tapering hole 5A of said fixture means 4A, said wedge 10 is also inserted into said splitting groove 9, thereby to enlarge the diameter of said end portion of said rod 3A up to the internal surface of said tapering hole 5A, simultaneously with filling the gap between said splitting groove 9 and said wedge 10 with said adhesive member 6A for preventing said drawing out of said rod 3A from said fixture means 4A. Further, in this polymer insulator 1A, a counter-tensile charge P which is larger than the maximum charge in use is also beforehand applied in the direction shown by the arrow in FIG. 2, so as to generate an urging force in the direction separating said rod 3A and said fixture 4A from each other. As a result, a gap 8A is formed on said bottom surface 5Aa of said tapering hole 5A by causing said rod 3A to shift in said direction of said arrow due to said counter-tensile force P.

In said polymer insulator 1A as shown in FIG. 2 and described above, its anti-wear performance is increased since enlarged end portion of said rod 3A bears directly against the inner surface of said inner surface of said tapering hole 5A. However, this type of polymer insulator 1A has the following inconvenience.

As described above, said adhesive member 6A should be formed from material which can be joined only to said rod 3A, not to said wedge 10, because said adhesive member 6A must separate compulsorily said rod 3A from said wedge 10 when said counter-tensile charge P is applied. This means that it is impossible to join integrally said rod 3A and said fixture means 4A by means of said adhesive member 6A. Consequently, when said counter-tensile charge P is applied, the end portion of said rod 3A which has been previously enlarged by pushing it sufficiently is now reduced again in its diameter, with the result of reduced fastening force between the outer surface of said rod 3A and the inner surface of said tapering hole 5A.

Further, a gap 8Aa is generated between said wedge 10 and said adhesive member 6A which is separated from said wedge 10, and this gap 8Aa allows for inward deformation of two branches of the end portion of said rod 3A, also bringing about reduced fastening force between the outer surface of said rod 3A and the inner surface of said tapering hole 5A.

Further, in practical use, when a charge which is larger than the maximum charge in use estimated for the polymer insulator or than counter-tensile charge P is applied thereto, or when bending moment M has been frequently applied thereon, said gap 8Aa becomes larger, such that said end portion of rod 3A which has been enlarged said wedge 10 will be again reduced, with the result that said rod 3A is finally drawn out from said fixture means 4A.

A further inconvenience is that, since radius of curvature of conical inner surface of said tapering hole 5A is significantly larger than that of enlarged end portion of said rod 3A as shown in FIG. 3, engaging surface area between the outer surface of the enlarged end portion of said rod 3A and the inner surface of said tapering hole 5A is strictly limited, thus bringing about a reduced wedge effect. Further, when bending moment M is generated between said rod 3A and said fixture means 4A, a sliding is caused at said engaging surface area, and/or a large effort is caused between angle portions of said rod 3A on the side of its groove 9 and the slanting surface of said wedge 10 as shown in the circle X of FIG. 3, thus bringing about crack and flaw starting from this portion in said rod 3A.

As is clear from the above description, stable fastening condition between rod 3,3A and fixture means 4,4A can not be maintained for a long period in any of polymer insulators 1 or 1A.

SUMMARY OF THE INVENTION

It is an object of the present invention to provide a polymer insulator having a stronger fastening force by means of rod and fixture means, which can maintain its stable fastening force for a long period and which can be assembled easily with a low cost and having higher accuracy and quality.

Polymer insulator according to the present invention for the purpose of achieving the above object is characterized by a rod having on its outer surface an umbrella-like housing or insulator layer and having end portions which are formed so as to be freely expand with at least one splitting groove; a fixture means having a mounting hole in which said end portion of said rod is inserted and having an inner surface tapering inwards against which the outer surface of said rod abuts in its expanded state; and a wedge means fixed in said mounting hole, said wedge means being inserted into a splitting groove formed in the end portion of said rod when said end portion of said rod is mounted into said mounting hole of said fixture means, the top end of said wedge means having an engaging portion which is held in said splitting groove thereby to cause the whole wedge means to engage in said splitting groove.

In such a structure as described above, said wedge means can push aside two branches of said splitting groove thereby to expand the end portion of rod and to directly abut the outer surface of said expanded end portion of said rod against the inner surface of said mounting hole thereby to integrally shift together with said rod, consequently with no gap between said rod and said wedge means. Accordingly, the wedge effect between said expanded end portion of the rod itself and said mounting hole becomes larger when said rod is pulled in the direction of its drawing out from said mounting hole, in contrast to the heretofore known structure shown in FIG. 1. Therefore, when a counter-tensile charge is beforehand applied or when a large tensile force is applied thereto in practical use, the fastening force between said rod and said fixture means can be considerably increased also due to the direct abutting of said rod against the inner surface of said mounting hole. Consequently, the stable fastening condition between said rod and said fixture means is prevented from loosening and is maintained for a long period. The assembly of said wedge means and said rod wherein said engaging portion of said wedge portion is held in said splitting groove of said rod without use of any adhesives therein can be inserted itself into said mounting hole.

Further, said polymer insulator according to the present invention is characterized in that said mounting hole of said fixture means in said polymer insulator has an inwards tapering inner surface that matches with substantially all the outer surface of said rod in its expanded state.

The polymer insulator which has adopted such a mechanism can carry out not only the same function as that of said polymer insulator, but also the following function, that is, wedge effect between the end portion of said rod and the inner surface of said mounting hole is considerably increased due to the direct abutting between all the outer surface of expanded end portion of said rod and all the inner surface of said mounting hole matching with each other. Further, the inner surface of said mounting hole is not formed in a conical shape, but in a shape which approximately matches with the outer surface of the end portion of said rod, that is, in an oblong shape of the end portion of said rod when it is expanded symmetrically on both sides. Accordingly, the end portion of said rod is guided by said oblong inner surface of said mounting hole to be automatically centered such as to obtain the matching between said inner and outer surfaces. Finally, the end portion of said rod and said mounting hole are joined to each other at approximately all regions of their inner and outer surfaces, thus preventing sliding between them caused by bending moment applied on the polymer insulator. Thus, wedging effect obtained between expanded end portion of said rod and said mounting hole formed such as to matching therewith is greatly increased with respect to the said polymer insulator.

Further, the polymer insulator according to the present invention is characterized in that the extending height of said engaging portion is such that the top end thereof reaches approximately the deepest point of said groove when said wedge means enlarges the end portion of said rod thereby to generate a wedging effect between said rod and the inner surface of said mounting hole.

In such a mechanism, decrease of wedging effect can be positively prevented since said engaging portion fills substantially the gap of said rod up to its deepest point.

Further, the polymer insulator according to the invention is characterized in that the surface of said engaging portion is provided with a means for increasing the engaging force with the inner surface of said splitting groove.

In such a mechanism, said wedge means can be engaged with said rod without use of any adhesives for the convenience of assembling operation.

DETAILED DESCRIPTION OF PREFERRED EMBODIMENTS

Figure 1:
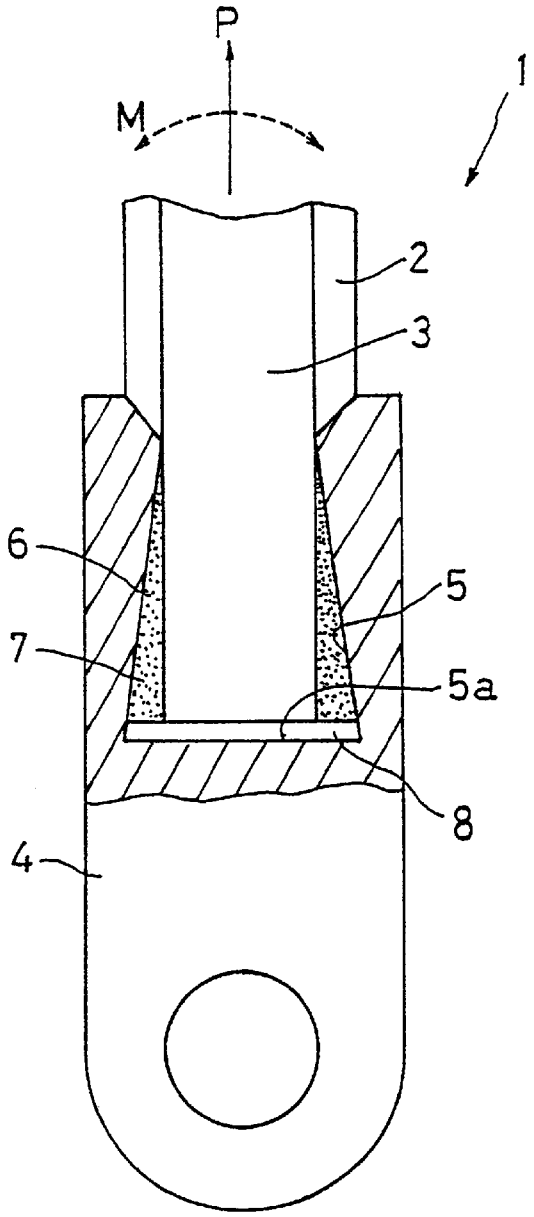
FIG. 1 is a partially broken enlarged view showing the assembly mechanism between rod and fixture means with its draft-preventing member in a heretofore known polymer insulator.
Figure 2:
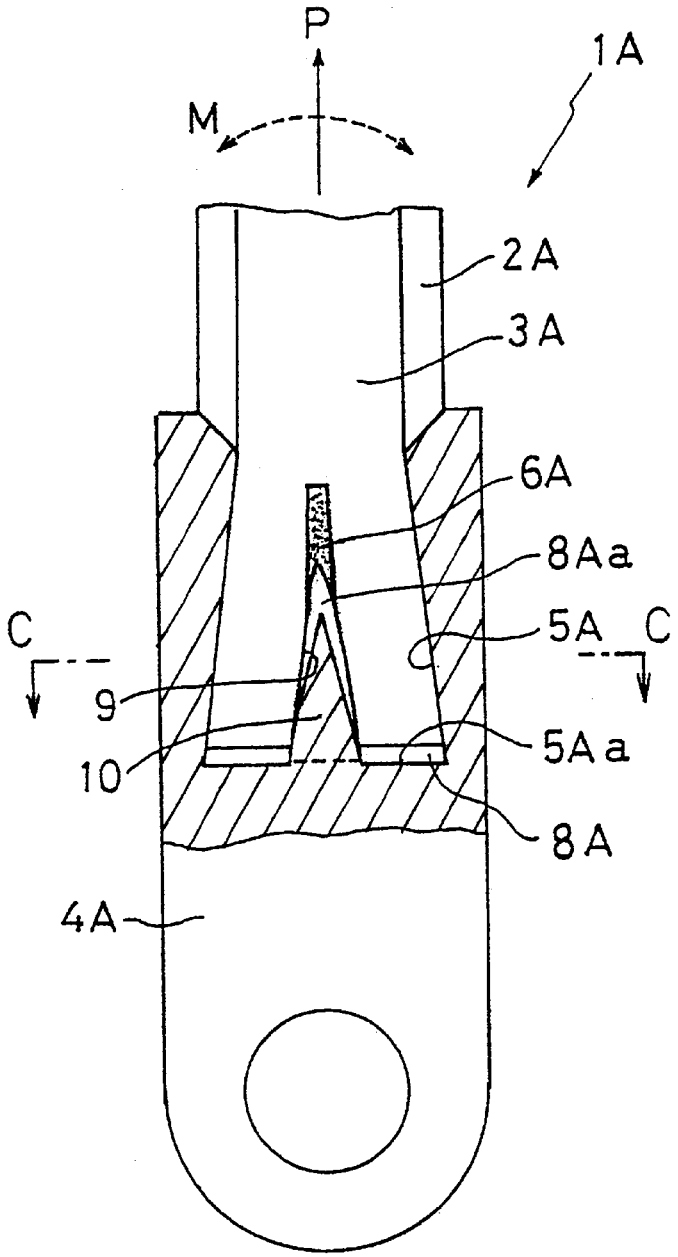
FIG. 2 is a partially broken enlarged view showing the assembly mechanism between rod and fixture means wherein wedges are inserted into splitting groove in the end potion of rod.
Figure 3:
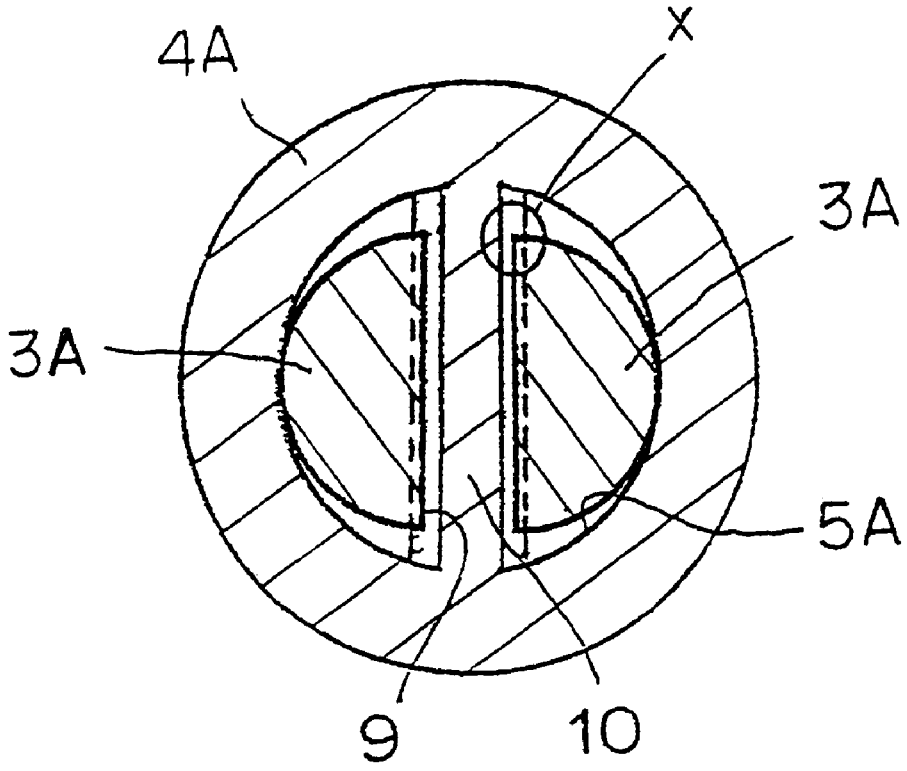
FIG. 3 is a cross section view taken along line C—C of FIG. 2.
Figure 4:
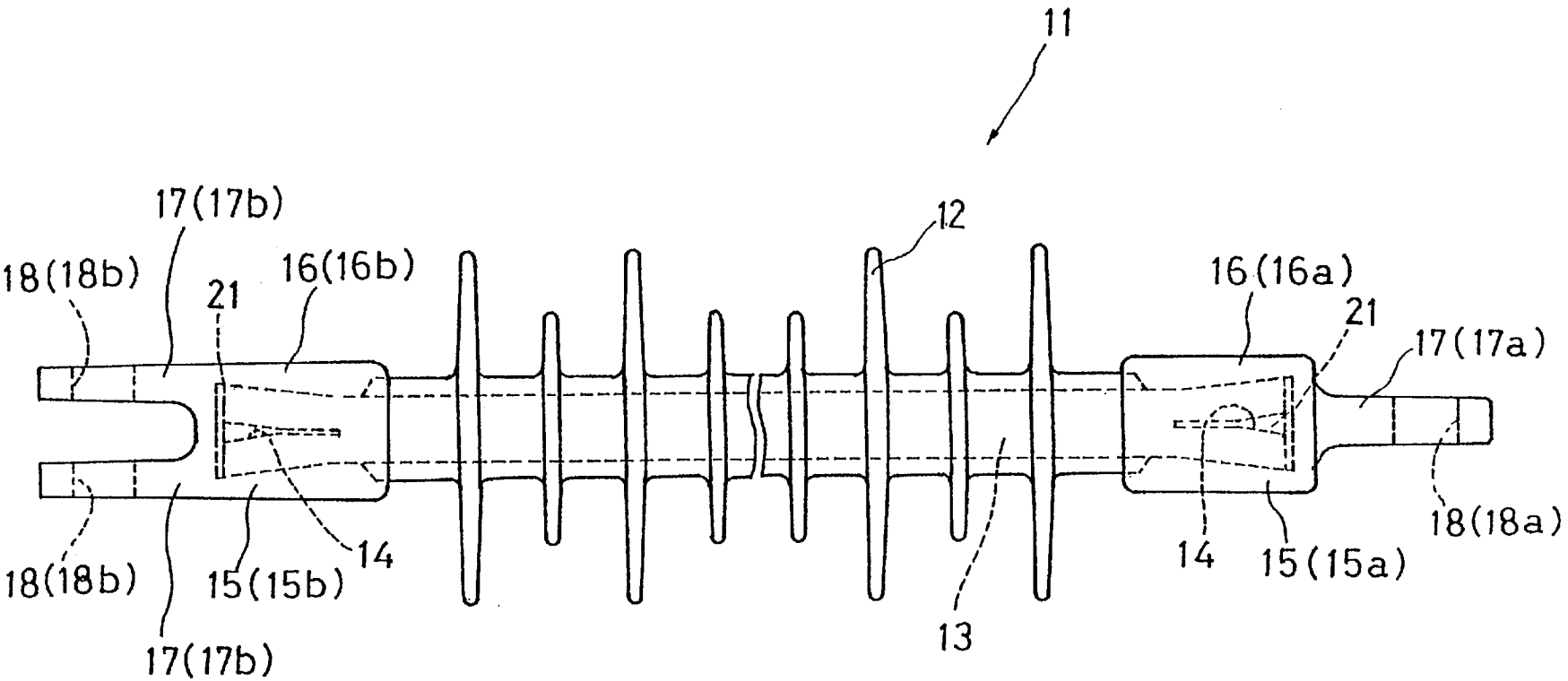
FIG. 4 is a front elevation view showing the essential portions of polymer insulator according to a first embodiment of the present invention.
Figure 5:
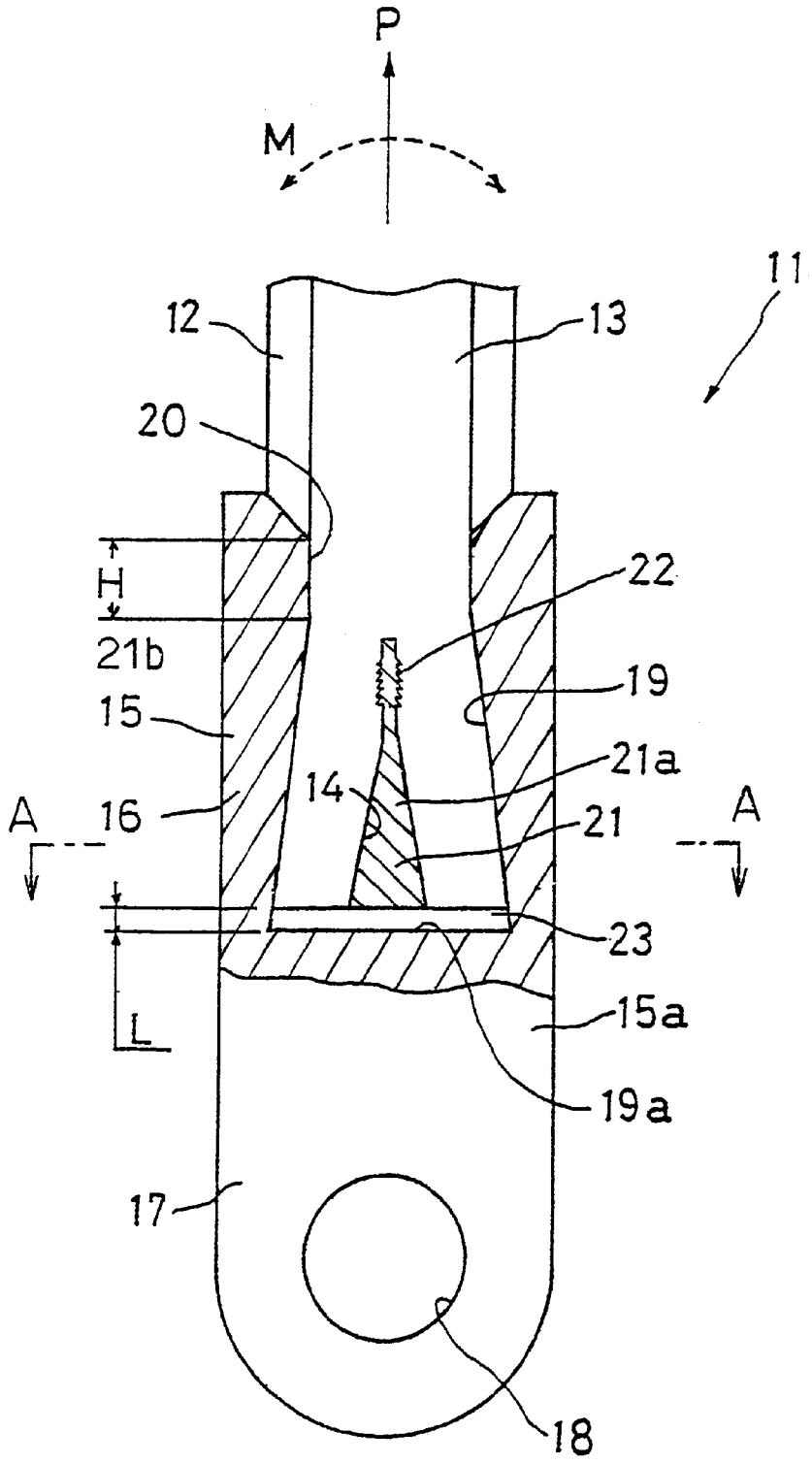
FIG. 5 is a partially broken enlarged view showing the assembling mechanism between rod and fixture means of the polymer insulator shown in FIG. 4.
Figure 6:
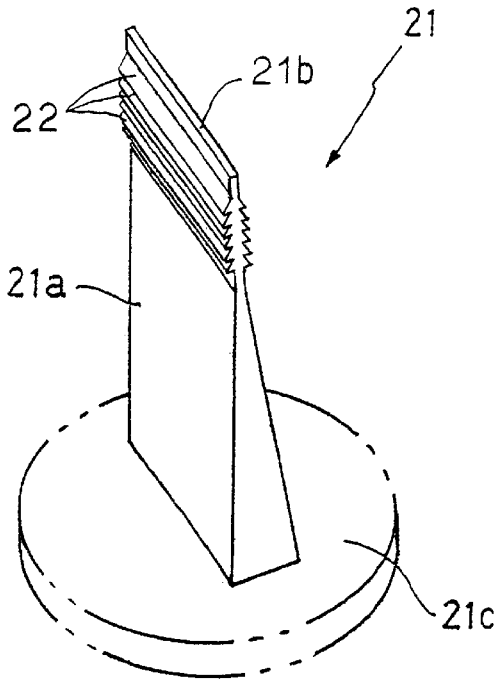
FIG. 6 is an enlarged perspective view of a wedge means of the polymer insulator of FIG. 4.
Figure 7:
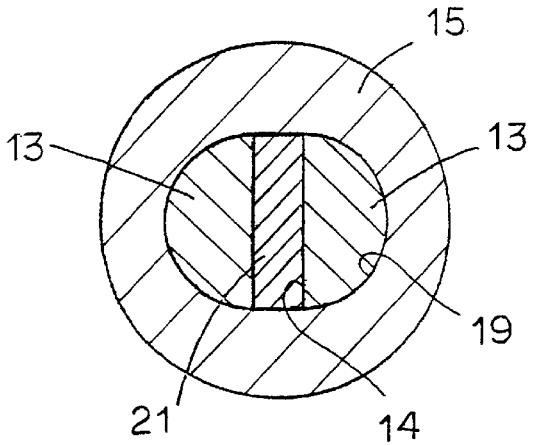
FIG. 7 is a cross section view taken along line A—A of FIG. 5.

In FIGS. 4–7 showing the structure of essential portions of an embodiment of polymer insulator according to the present invention, FIG. 4 is a front elevation view of the whole structure, FIG. 5 is a partially broken out enlarged view of fixing portion of rod and fixture means, FIG. 6 is an enlarged perspective view of wedge, and FIG. 7 is a cross-sectional view taken along line A—A of FIG. 2.

With reference to FIG. 4, polymer insulator 11 according to the invention has a cylindrical rod 13 of resin such as FRP, on the outer surface of which is provided an umbrella like housing 12 formed from insulating material such as gum. On each end portion of said rod 13, there is formed a splitting groove 14 having substantially parallel side edges for splitting said end portion of said rod 13.

In this case, it is preferable to form the starting portion of said splitting groove 14 in a curve form such as r-form for the purpose of preventing said deepest or root portion of groove 14 from splitting due to effort concentrated thereto when a wedge 21 described below is inserted into said groove 14.

A pair of fixture means 15 made from metal such as black heart malleable castings is mounted on each end of said rod 13. Each fixture means 15 has a substantially cylindrical base 16 in which the end portion of said rod 13 is mounted and a fixing portion 17 extending out from the end surface of said base 16 in the axial direction, with a mounting hole 18 being formed in said fixing portion 17 so as to penetrate it in the thickness direction thereof.

Fixture means 15*a* shown on the right hand of FIG. 4 has a plate-like fixing portion 17*a* extending rightwards from end surface of cylindrical base 16*a* in which one end of said cylindrical rod 13 is inserted, said fixing portion 17*a* having therein a mounting hole 18*a*.

Fixture means 15*b* shown on the left hand of FIG. 4 has a pair of plate-like and parallel branch-like fixing portions 17*b*,17*b* extending leftwards from end surface of cylindrical base 16*b* in which the other end of said cylindrical rod 13 is inserted, each of said fixing portion 17*b* having therein a mounting hole 18*b*.

Since said respective bases 16*a*,16*b* of said fixture means 15*a*,15*b* have the same structure, this structure of base 16 is now described with respect to said fixture means 15*a* shown on the right hand of FIG. 4.

One end of base 16 of said fixture means 15 has formed herein a mounting hole 19 having inwards tapering inner surface substantially matching with substantially whole outer surface of end portion of rod 13 inserted and expanded therein, as shown in FIGS. 5 and 7. Accordingly, the inner surface of said mounting hole 19 is provided with not a conical but a substantially oblong cross section so as to match with substantially whole outer surface of expanded rod 13. The internal diameter of opening shown in FIG. 5 in its upper portion is larger than the outer diameter of said rod 13 by the order of 0.1–1.5 mm. The inwards tapering mounting hole 19 is enlarged towards its bottom surface 19*a* shown on the lower of FIG. 2 with a taper angle of 2–6 degrees at the long diameter of said oblong cross section. Further, said mounting hole 19 has at its upper portion a cylindrical portion of supporting hole of height H reaching said opening.

A wedge means 21 is located on the bottom surface of said mounting hole 19*a*, said wedge means 21 being separately formed by aluminium die casting for example, as shown in FIG. 6. Said wedge means 21 has also a wedge portion 21*a* for inserting it into said splitting groove 14 of said rod 13 thereby to enlarge the end portion of this rod 13. The top end of said wedge means 21 has formed thereon an extending engaging portion 21*b* which is inserted into said splitting groove 14 and is held therein in order to engage the whole wedge means 21 in said rod 13. In this embodiment, the extending height of said engaging portion 21*b* is such that the top end thereof reaches approximately the deepest point of said groove 14 when said wedge means 21 enlarges the end portion of said rod 13 thereby to generate a wedging effect between said rod 13 and the inner surface of said mounting hole 19. Both left and right surfaces of said engaging portion 21*b* are provided with a plurality of parallel ribs 22, 22 having each triangle cross section which are used as means for increasing the engaging force by biting into the inner surface of said groove 14. It is preferable to form said ribs 22 which can be easily inserted into said groove 14 and can not be easily drawn out therefrom. For this purpose, these ribs 22 have each an upper loose slant and a sharp summit directed downwards in FIG. 6. Number and shape of this means for increasing the engaging force may be suitably modified so long as it can carry out its function.

The operation of polymer insulator 11 according to the invention is now described herein below with respect to the mounting operation of said rod 13 and said fixture means 15.

Firstly, said engaging portion 21*b* of said wedge means 21 is inserted into said splitting groove 14 and is stopped when the top end of said wedge portion 21*a* advances to a point which is immediately before the deepest point of said splitting groove 14. Thus, said engaging portion 21*b* can be held by the end portion of said rod 13 thereby to support said wedge means 21 so as not to be easily drawn out from said groove 14 and in a coaxial relationship with respect to said rod 13. Consequently, no adhesives are necessary for said wedge means 21 to be supported by said rod 13, thus assembling operation thereof becoming easier. In this operation, it is essential not to enlarge the end portion of said rod 13 to an outer diameter larger than the inner diameter of said support hole 20.

Secondly, in this step of assembling, insertion of said rod 13 into said supporting hole 20 and said mounting hole 19 is now started. It is essential in this insertion to match the direction of enlarging the end portion of said rod 13 by means of said wedge means 21 with the direction of long diameter of said oblong cross section which is enlarged towards said bottom surface 19*a* of said mounting hole 19. In this step, outer surface of the end portion of said rod 13 is guided along said supporting hole 20 having a height H.

Thus, the relative position of said rod 13 and said fixture means 15 can be easily controlled thereby to prevent any slant mounting of said rod 13 into said fixture means 15.

When the end portion of said rod 13 is inserted into said mounting hole 19 of said fixture means 15, the bottom surface of said wedge portion 21*a* of said wedge 21 bears against the bottom surface 19*a* of said mounting hole 19. When said end portion of said rod 13 is further inserted into said mounting hole 19, the top end of said wedge portion 21*a* is pushed into said groove 14 of said rod 13, thereby to expand gradually both branches of said end portion of rod 13. Since the end portion of said rod 13 is expanded symmetrically on both sides, so that said both branches of said end portion of said rod 13 are guided by the oblong internal surface of said mounting hole 19 for automatic centering so as to match the outer surface of said rod 13 with said oblong internal surface. Due to such an abutting of the outer surface of said end portion of said rod 13 against the oblong inner surface of said mounting hole 19, expansion of said rod 13 is stopped, thus finishing insertion of said rod 13 into said fixture means 15 thereby preventing the relative rotation between said rod 13 and said fixture means 15. When a wedge effect has been obtained between said mounting hole 19 and said end portion of said rod 13 by expanding the latter, the top end of said engaging portion 21*b* reaches and fills up the deepest point of said splitting groove 14 while being held by the inner surfaces of said groove 14 thereby to positively prevent said wedge means 21 from drawing out from said groove 14.

When said rod 13 is now pulled in the direction of arrow P in FIG. 5 by a force equivalent to said counter-tensile charge P, the end portion of said rod 13 is shifted by a length L in the direction of arrow P, thereby to generate a surface pressure between the outer surface of said rod 13 and substantially whole inner surface of said mounting hole 19 of said fixture means 15. In this condition, a gap 23 corresponding to the shift distance L of said rod 13 is formed between the bottom surface of said wedge means 21 and the bottom surface 19*a* of said mounting hole 19, thus finishing mounting of said rod 13 into said fixture means 15. Thus in this embodiment, said wedge means 21 and said rod 13 form an integral member to be shifted together, and the gap between said groove 14 of said rod 13 and the top end of said wedge portion 21*a* of wedge means 21 is filled by said engaging portion 21*b*, so as to form a solid wedge assembly without elastic deformation of the end portion of said rod 13 such as shown in FIG. 2.

Figure 8:
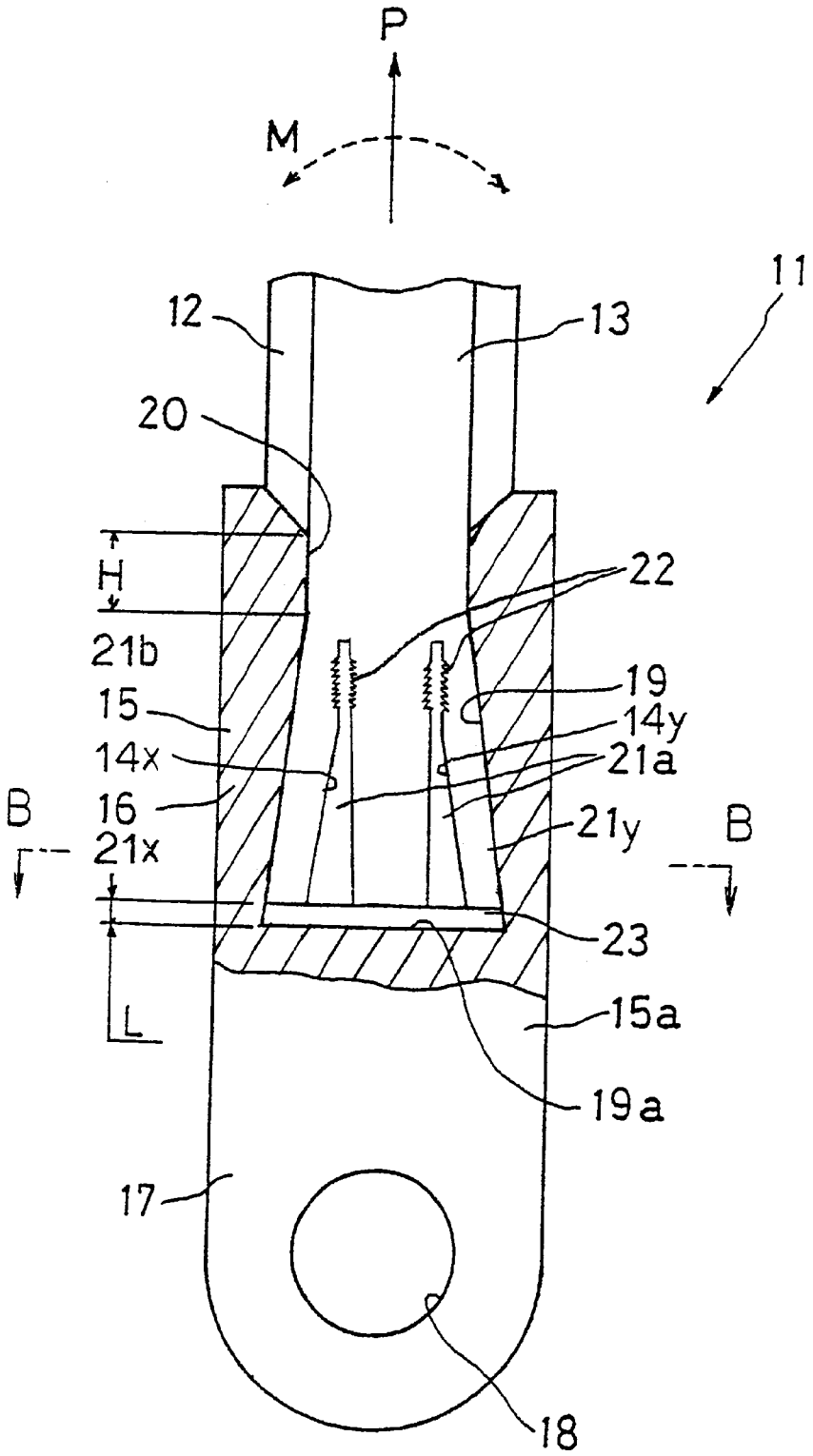
FIG. 8 is a view similar to FIG. 5 for showing the second embodiment of polymer insulator according to the invention.

Due to said strong surface pressure between the outer surface of the end portion of said rod 13 and the inner surface of said mounting hole 19, a large fastening force between these surfaces can be obtained for a long period. It was determined by a test that this fastening force between said rod 13 and said fixture means 15 in polymer insulator 11 according to the invention is increased by 1.5–2.0 times with respect to that of heretofore known polymer insulator 1 as shown in FIG. 8 using a draft-preventing member 7.

Further, when said rod 13 is mounted into said fixture means 15, the portion near to its end can be supported from outside in the diametrical direction and for the axial height H by said supporting hole 20 of said fixture means 15, so that the position of said rod 13 when inserted into said fixture means 15 can be controlled so as to obtain a positive and proper mounting condition and prevent oscillation of said rod 13 when bending moment M is applied thereon.

Said automatic centering between said rod 13 and said fixture means 15 when inserting said rod 13 allows for a high positional accuracy between these two members can be obtained. As a result, there is obtained a smaller dispersion of said distance L corresponding to the shift of rod 13 under said counter-tensile charge P which is larger than maximum use charge, and thus a smaller dispersion in the length of polymer insulator 11 for respective products, so that high quality products with higher dimensional accuracy can be obtained in a stable manner.

A further guide member 21*c* having a diameter smaller than the inner diameter of said supporting hole 20 can be formed at the bottom portion of said wedge means 21, as shown in FIG. 6 by a chain line. Said guide member 21*c* serves to hold the rod 13 coaxial when the latter is inserted into said fixture means 15 and to guide said wedge means 21 in the vertical direction when it is pushed on said bottom surface 19*a* of said mounting hole 19 when said wedge means 21 is further inserted into said groove 14 after said guide portion 21 has abutted against said bottom surface 19*a* thereby to improve the coaxial arrangement in mounting operation.

Figure 9:
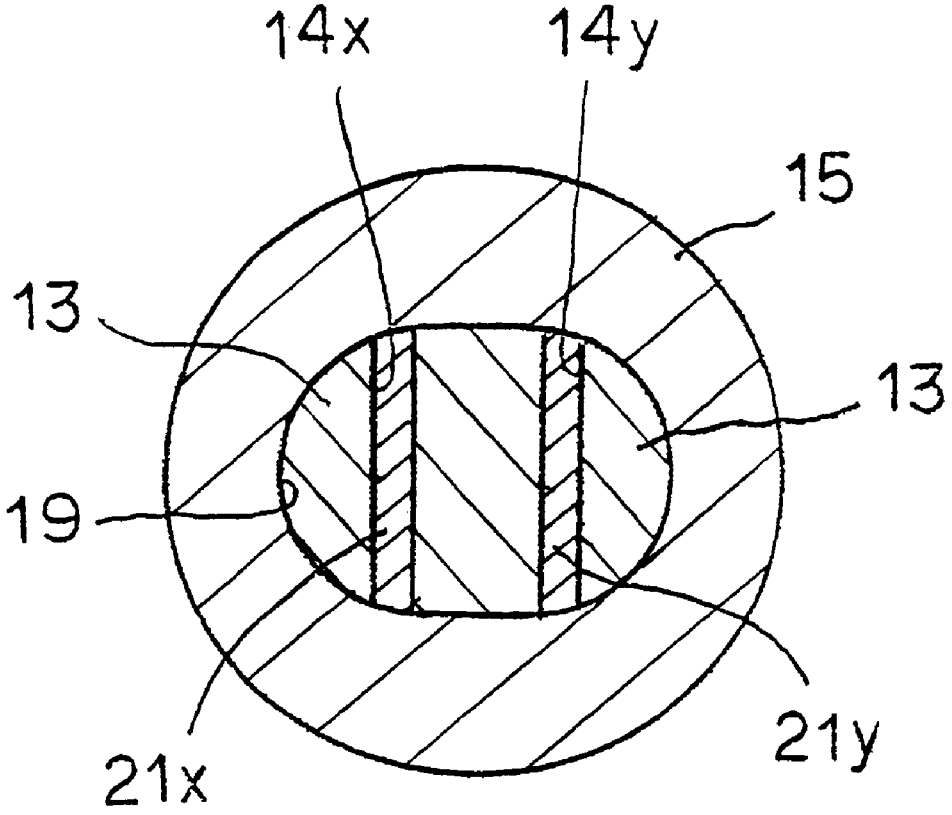
FIG. 9 is a cross section view taken along line B—B of FIG. 8.

The second embodiment according to the invention shown FIG. 8 and FIG. 9 is similar to the first embodiment described above, except that two parallel grooves 14*x*, 14*y* are provided on the bottom portion of said rod 13 with two wedge means 21*x*, 21*y* being inserted into said respective grooves 14*x*, 14*y* in place of said single groove 14 and said single wedge means 21. Each wedge means 21*x*, 21*y* has a structure quite similar to that of said wedge means 21, comprising each a wedge portion 21*a* to be inserted into corresponding groove 14*x*, 14*y* for expanding said end portion of said rod 13 and an engaging portion 21*b* formed at the top end of said wedge portion 21*a* to be inserted into said grooves 14*x*, 14*y* for engaging each wedge means 21*x*, 21*y* with said rod 13. The extending length of said engaging portion 21*b* from said wedge portion 21*a* is such that the top end of said engaging portion 21*b* reaches the deepest point of said groove 14*x* and 14*y* thereby to expand the end portion of said rod 13 to generate a wedge effect between said rod 13 and the inner surface of said mounting hole 19. Further, Both left and right surface of said engaging portion 21*b* are provided with a plurality of parallel ribs 22, 22 having each triangle cross section which are used as means for increasing the engaging force by biting into the inner surface of said groove 14*x*, 14*y*.

As described above, this embodiment of the present invention uses two pairs of splitting groove 14*x*, 14*y* and one pair of wedge means 21*x*, 21*y* for expanding the end portion of said rod 13 thereby to tightly lock substantially all the outer surface of the end portion of said rod 13 against the inner surface of said mounting hole 19 for developing a large wedge effect as shown in FIG. 9. Consequently, when this embodiment is applied on a larger diameter of said rod 13, the end portion thereof can be advantageously enlarged to a greater extent.

The shape of wedge portion 21*a* of said wedge means 21*x*, 21*y* may be a wedge form having one lateral tapering surface. In this case, respective wedge portions 21*a* with its vertical surface located inside can be advantageously inserted into said groove 14*x*, 14*y*.

Further, three, four or more pairs of said groove 14 and said wedge means 21 can be arranged equidistantly along the periphery of said rod 13, wherein the inner surface of said mounting hole 19 can be formed such as to match with the outer surface of the end portion of said rod 13 expanding radially at three or more regions, or otherwise the inner surface of said mounting hole 19 can be formed into a simple conical tapering surface since the number of regions of said end portion of said rod 13 abutting against the inner surface of said mounting hole 19 is so large as three or more.

The invention is not limited to the above described embodiments, but variations and modifications may be made thereto without departing from the spirit of the inventive concept disclosed herein.

It will be clear from the above description that the polymer insulator according to the present invention can advantageously increase the fastening force between rod and fixture means so that a stable fastening condition between them can be held for a long period, thereby to obtain a polymer insulator of high quality having an excellent global dimension accuracy, and these advantages can be achieved without any adhesives and in a simple assembling operation.

What is claimed is:

1. Polymer insulator which is characterized by a rod having on its outer surface an umbrella-like housing or insulator layer and having end portions which are formed so as to be freely expanded with at least one splitting groove; a fixture means having a mounting hole in which said end portions of said rod are inserted and which has an inner surface tapering inwards against which the outer surface of said rod abuts in its expanded state; and a wedge means fixed in said mounting hole, said wedge means being inserted into said at least one splitting groove formed in the end portions of said rod when said end portions of said rod are mounted into said mounting hole of said fixture means, the top end of said wedge means having an engaging portion which is held in said at least one splitting groove thereby to cause, said engaging portion to increase the engaging force with the inner surface of said at least one splitting groove when said wedge means is engaged in said at least one splitting groove.

2. Polymer insulator which is characterized by a rod having on its outer surface an umbrella-like housing or insulator layer and having end portions which are formed so as to be freely expanded with at least one splitting groove; a fixture means having a mounting hole in which said end portions of said rod are inserted and which has an inner surface tapering inwards, said inner surface matching with the outer surface of said rod in its expanded state; and a wedge means fixed in said mounting hole, said wedge means being inserted into said at least one splitting groove formed in the end portions of said rod when said end portions of said rod are mounted into said mounting hole of said fixture means, the top end of said wedge means having an engaging portion which is held in said at least one splitting groove thereby to engage the wedge means in said at least one splitting groove to increase the engaging force with the inner surface of said at least one splitting groove.

3. Polymer insulator claimed in claim 1 characterized in that said engaging portion of the wedge means is extended such that said wedge means reaches approximately the deepest point of said at least one groove when said wedge means enlarges the end portions of said rod thereby to increase the wedging effect between said rod and the inner surface of said mounting hole increasing the engaging force with the inner surface of said at least one splitting groove.

* * * * *